United States Patent [19]

Chaussadas

[11] Patent Number: 4,875,586

[45] Date of Patent: Oct. 24, 1989

[54] MULTIPACK WITH TOP PANEL KEEL

[75] Inventor: Jean Chaussadas, Brassioux, France

[73] Assignee: The Mead Corporation, Dayton, Ohio

[21] Appl. No.: 319,032

[22] Filed: Mar. 6, 1989

[51] Int. Cl.[4] ..... B65D 71/00

[52] U.S. Cl. ..... 206/427; 206/158

[58] Field of Search ..... 229/52 BC; 206/427, 206/148, 434, 158

[56] References Cited

U.S. PATENT DOCUMENTS

| | | | |
|---|---|---|---|
| 3,593,849 | 7/1971 | Helms et al. | 206/427 |
| 3,674,137 | 7/1972 | Graser | 206/158 |
| 4,300,680 | 11/1981 | Champlin | 206/427 |
| 4,339,032 | 7/1982 | Wood | 206/427 X |
| 4,545,485 | 10/1985 | Oliff | 206/427 |
| 4,601,390 | 7/1986 | Rosenthal et al. | 206/427 |
| 4,815,599 | 3/1989 | Schuster | 206/427 |

OTHER PUBLICATIONS

WO 87/02649, Wilson, PCT, 5/1987.

*Primary Examiner*—William Price
*Attorney, Agent, or Firm*—Thomas B. Boshinski

[57] ABSTRACT

A carton (C) accomodating a plurality of like articles such as bottles (B) arranged in a group, the carton comprising a top panel (18), base panel means (12,24) and spaced side wall panels (16,20) interconnecting and hinged to opposed side edges of top panel and base panel means. One of the bottles (B*c*) is arranged centrally of the group and a locking and separating keel (38) being provided by the top panel which has portions displaced out of the plane of the top panel holds said central bottle centrally of the group while maintaining the relative spacing of adjacent bottles in the group.

7 Claims, 2 Drawing Sheets

MULTIPACK WITH TOP PANEL KEEL

BACKGROUND OF THE INVENTION

The present invention relates to a carton accommodating a plurality of like articles, such as bottles, wherein a keel is used to maintain the relative spacing of the adjacent bottles in the group within the carton.

Bottle carriers wherein the upper end of the carton engages the tops of the bottles are known. In U.S. Pat. No. 3,593,849, a wraparound carrier includes side panels which extend upwardly and are inclined toward each other to conform to the neck portions of the bottles. These side panels are joined by a narrow panel overlying the tops of the bottles, the narrow panel being scored and slit to provide a pair of finger holes on each side of an intermediate one of the bottles. This construction provides confronting gusset folds to reinforce the carrier in the area of the finger holes and to stabilize the intermediate bottle.

In U.S. Pat. No. 3,674,137, a carrier for bottles is shown having a top panel with openings through which the necks of the bottles will extend. The apertures have associated therewith at least one retention tab attached near the periphery of the apertures and which extend into the apertures. The tabs afford a retention means that will assist in preventing the bottle fallout when the carrier is used.

Other references showing bottle carriers having top panels with apertures which engage the tops of the bottles to retain the bottles within the carrier and to maintain relative spacing between the bottles include U.S. Pat. Nos. 4,300,680; 4,339,032; and 4,545,485, and published international application WO87/02649.

SUMMARY OF THE INVENTION

The invention provides a carton accommodating a plurality of like articles, such as bottles, arranged in a group in which one of the bottles is disposed centrally of the group. Locking and separator means, in the form of a keel, holds the central bottle centrally of the group while maintaining the relative spacing of adjacent bottles in the group.

The keel not only holds the central bottle in position during the packaging process but also provides protection for the top of the completed carton which otherwise would be vulnerable to damage.

One aspect of the invention provides a carton accommodating a plurality of like articles, such as bottles, arranged in a group which carton comprises a top panel, base panel means and spaced side wall panels interconnecting and hinged to opposed side edges of the top panel and base panel means, one of said bottles being arranged centrally of a group and wherein locking and separating means provided at least in part by said top panel and having portions thereof displaced out of the plane of said top panel holds said central bottle centrally of said group while maintaining the relative spacing of adjacent bottles in the group.

According to a feature of this aspect of the invention, said locking and separating means may include a locking aperture having a locking edge in locking engagement with the cap of said central bottle.

Preferably, the locking and separating means comprises a bridge extending between bottles disposed at each of the opposite ends of said carton which bridge comprises a top panel portion overlying the top of said central bottle and opposed side panel portions each of which includes one of said locking apertures.

In such constructions, it is preferred that each of said side wall portions of the bridge is provided by a downwardly and inwardly displaced portion of the top panel of said carton.

It is also preferable for each of said side wall portions of the bridge to be hinged to an adjacent side wall panel of the carton by a step panel provided by an inwardly displaced portion of that adjacent side wall panel.

According to another feature of this aspect of the invention, the adjacent end edges of the side wall portions and step panels at each of the opposite ends of said bridge engage against the neck portion of one of said adjacent bottles to hold that bottle spaced from said central bottle.

Preferably, the carton is one of the wraparound type and in which end panel closure means hinged to opposite ends of said top panel assist in preventing endwise dislodgement of said adjacent bottles from the ends of the carton.

Another aspect of the invention provides a carton blank for forming a carton according to any of the seven immediately preceding paragraphs.

DETAILED DESCRIPTION OF THE PREFERRED EMBODIMENT

Figure 1:
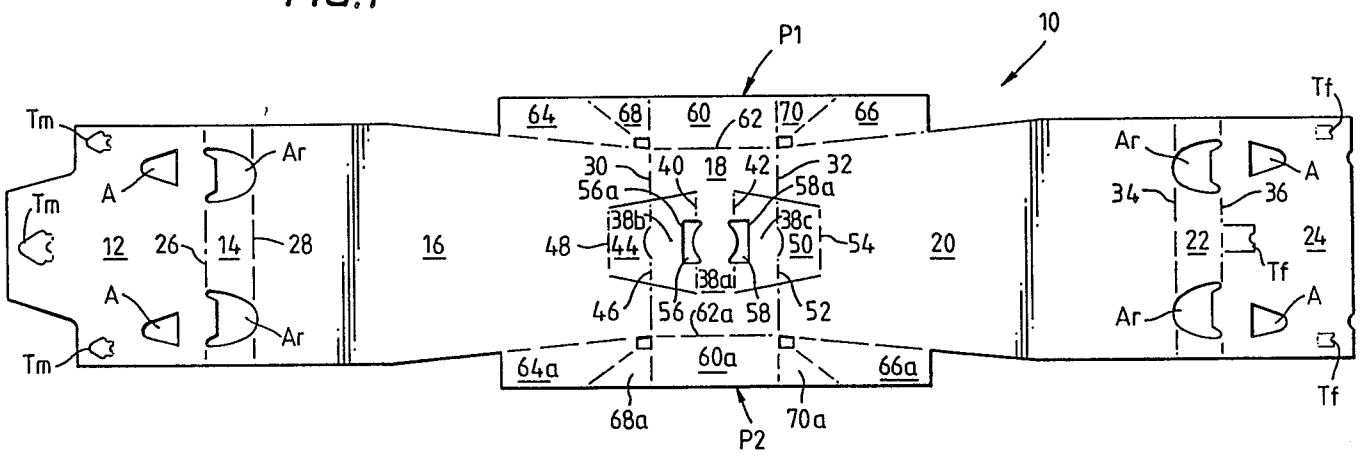
FIG. 1 is plan view of a paperboard blank from which a carton according to the invention is formed.

Referring to the drawings, a wraparound type carton 'C' for bottles 'B' is formed from an elongated blank 10 of paperboard or similar foldable sheet material and comprises, in series, a first base panel 12; a first heel panel 14; a first side wall panel 16; a top wall panel 18; a second side wall panel 20; a second heel panel 22; and a second base panel 24 hinged one to the next along transverse fold lines 26–36 respectively.

As is well known in the art, when the carton is loaded and formed, the two base panels 12 and 24 are brought into overlapping relationship and interlocked by means of male locking tabs 'Tm' provided by base panel 12 and female locking apertures defined by tabs 'Tf' provided by base panel 24 in which locking tabs Tm are punched through the cooperating locking apertures. In order to align the cooperating locking tabs and apertures, tightening apertures 'A' are provided in both base panels in which suitable packaging machine tightening elements can engage to draw the base panels together into correct alignment.

Also well known is the provision of bottle heel retaining aperture 'AR' provided in each of the heel panels 14 and 22 which assist in the retention of the bottles adjacent the side wall of the carton. The heel panels are able to better conform to the heel portions of the bottles by virtue of their integral hinged connections to their associated side and base panels.

Figure 2:
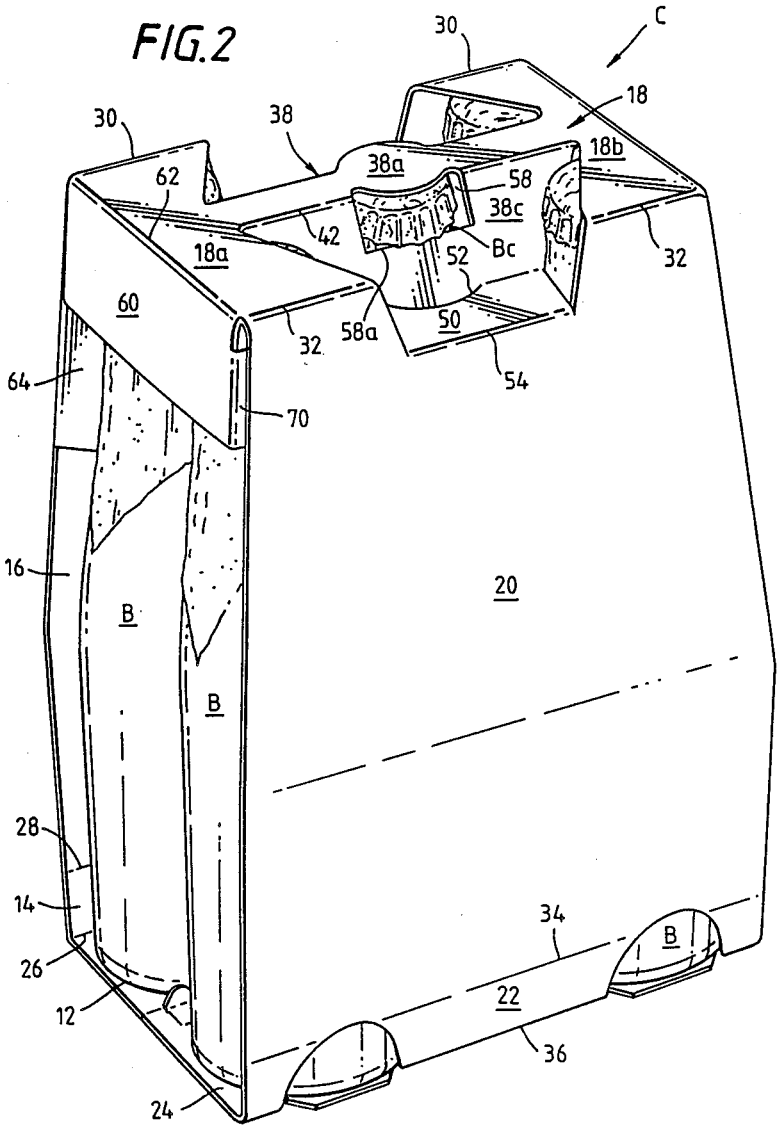
FIG. 2 is a perspective view of a carton according to the invention as seen from above and from one end.

The carton depicted in FIG. 2, accommodates five similar bottles, arranged in two rows of two bottles per row and one bottle Bc arranged centrally of the carton and with respect to the other four adjacent bottles B. The four outermost bottles B each have heel portions thereof engaged in a respective one of the heel retaining apertures 'AR' to assist in the retention of the lower portions of those bottles. The top panel 18 is fabricated so as to assist in the retention and spacing of neck portions of the packed bottles.

Top panel 18 includes a locking and separator keel 38 which extends between upper portions of the bottles at each end of the carton and engages over upper neck portion of the central bottle Bc. The locking and separator keel 38 comprises a top panel portion 38*a*, integrally joined to opposite end portions 18*a* and 18*b* of the top panel which overlies the top of central bottle Bc, and side panel portions 38*b* and 38*c* which flank diametrically opposed neck portions of central bottle Bc. The side panel portions 38*b*, 38*c* of the keel are hinged to opposed edge of the top panel portion 38*a* of the keel along fold lines 40 and 42 respectively. The locking and separating keel is integrally connected to a step panel at each of its opposite sides, each step panel being struck from the adjacent side wall panel of the carton. Thus, step panel 44 is hinged to the lowermost edge of the side panel portion 38*b* of the keel along fold line 46 and also hinged to side wall panel 16 along fold line 48. Likewise, step panel 50 is hinged to the lowermost edge of the side panel portion 38*c* of the keel along fold line 52 and also hinged to side wall panel 20 along fold line 54. Bottle top locking apertures 56 and 58 are struck from the opposite side wall portions 38*b* and 38*c* respectively of the keel 38 to received opposed portions of the top of central bottle Bc when the keel 38 is formed.

Each of the bottle top locking apertures is defined in part by a locking edge 56*a* and 58*a* respectively which engages beneath the lower lip of a bottle cap as the top is received in the associated aperture. The locking and separator keel 38 is formed during formation of the package to maintain the central position of center bottle 'Bc' and to hold top portions of the other bottles in their correct relatively spaced positions.

However, initially all the keel panel portions and the step panels are flat in the plane of the blank 10 whereby fold lines 46 and 52 are coincident with fold lines 30 and 32 respectively. When the blank is applied to a preformed group of bottles so that the top panel 18 overlies the bottle caps, the locking and separator keel can be erected simply by displacing the side panel portions of the keel and the step panels about fold lines 40, 46, 48 and 42, 52, 54 inwardly towards the central bottle Bc until the locking edges of the bottle top locking apertures engage beneath the lower lip portions of the bottle cap. It will be appreciated that the end edge of the keel side wall panels and the end edges of the step panels contiguous therewith in each case, together engage a neck portion of a respective one of the outermost bottles 'B' so that the upper portions of those bottles are kept spaced relative to central bottle Bc. In order to prevent endwise dislodgement of the outermost bottles 'B' from the carton an end panel construction P1, P2 known per se is provided at each of the open ends of the carton so as to partially close the open ends. End panel construction P2 is in all respects similar to P1 and therefore like reference numerals in P2 designate like parts of P1 with the addition of suffix 'a'. Thus end panel construction P1 includes an end panel 60 hinged to one longitudinal edge of top panel 18 along fold line 62. End panel 60 is integrally connected at its opposite ends to tuck flaps 64 and 66 respectively by means of interconnecting foldable gusset panels 68 and 70 respectively. Thus, when the tuck flaps are folded inwardly of the carton against the internal faces of the respective side wall panels, the end panels are caused to fold downwardly about fold line 62 to the top panel 18 across the upper part of the associated carton end.

While the carton described herein constitutes a preferred embodiment of this invention, it is to be understood that the invention is not limited to this precise form, and that changes may be made therein without departing from the scope of the invention, which is defined in the appended claims.

What is claimed is:

1. A carton for accommodating a plurality of articles such as bottles arranged in a group including at least four bottles arranged in at least two parallel rows and a center bottle disposed intermediate said rows, said carton comprising:

a top panel, base panel means and spaced side wall panels interconnected and hinged to opposite side edges of said top panel and said base panel means; and locking and separating means provided at least in part by said top panel and having portions thereof displaced out of the plane of said top panel, for holding said central bottle centrally of said group while maintaining the relative spacing of adjacent bottles in said group.

2. A carton as defined in claim 1, wherein said locking and separating means includes a locking aperture defining a locking edge positioned in locking engagement with a cap of said central bottle.

3. A carton according to claim 2, wherein said locking and separating means comprises a bridge extending between bottle disposed at each of the opposite ends of said carton, which bridge comprises a top panel portion overlying the top of said central bottle and opposed side panel portions, each of which includes one of said locking apertures.

4. A carton according to claim 3, wherein each of said side wall portions of said bridge includes a downwardly and inwardly displaced portion of the top panel of said carton.

5. A carton according to claim 3, wherein each of said side wall portions of the bridge is hinged to an adjacent one of said side wall panel of the carton by a step panel provided by an inwardly displaced portion of said adjacent side wall panel.

6. A carton according to claim 5, wherein the adjacent end edges of said side wall portions and said step panels at each of the opposite ends of said bridge engage against the neck portion of one of said adjacent bottles to hold said one bottle spaced from said central bottle.

7. A carton according to claim 1 further comprising end panel closure means hinged to opposite ends of said top panel to assist in preventing endwise dislodgement of said adjacent bottles from the ends of the carton.

* * * * *